US009115641B2

(12) United States Patent
Arner et al.

(10) Patent No.: US 9,115,641 B2
(45) Date of Patent: Aug. 25, 2015

(54) METHODS AND SYSTEMS FOR AN ENGINE

(75) Inventors: James Edward Arner, Lawrence Park, PA (US); John Patrick Dowell, Grove City, PA (US); Shashi Kiran, Lawrence Park, PA (US); Alexis Gruschow, Lawrence Park, PA (US); Milan Shah, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 395 days.

(21) Appl. No.: 13/589,224

(22) Filed: Aug. 20, 2012

(65) Prior Publication Data

US 2014/0052360 A1 Feb. 20, 2014

(51) Int. Cl.

| | |
|---|---|
| ***F02D 45/00*** | (2006.01) |
| ***F02M 63/00*** | (2006.01) |
| ***F01D 25/12*** | (2006.01) |
| ***F02B 39/00*** | (2006.01) |
| ***F02M 53/04*** | (2006.01) |

(52) U.S. Cl.

CPC ..... *F02B 39/005* (2013.01); *F02M 53/04* (2013.01); *F02M 2700/077* (2013.01)

(58) Field of Classification Search

USPC ..... 701/102, 108, 103, 104; 123/41.1, 123/41.29, 41.31, 41.82 R, 559.1, 559.2; 60/599, 605.3

See application file for complete search history.

(56) References Cited

U.S. PATENT DOCUMENTS

| | | | | |
|---|---|---|---|---|
| 6,006,515 | A * | 12/1999 | Wakamoto | 60/274 |
| 6,513,328 | B2 * | 2/2003 | Baeuerle et al. | 60/599 |
| 6,883,308 | B2 * | 4/2005 | Megas et al. | 60/280 |
| 6,895,745 | B2 * | 5/2005 | Roby | 60/280 |
| 7,784,274 | B2 | 8/2010 | Winsor | |
| RE42,875 | E * | 11/2011 | Fischer et al. | 60/606 |
| 2008/0016849 | A1 | 1/2008 | McCarthy et al. | |
| 2009/0064668 | A1 | 3/2009 | Herrick et al. | |

* cited by examiner

*Primary Examiner* — John Kwon
*Assistant Examiner* — Johnny H Hoang
(74) *Attorney, Agent, or Firm* — GE Global Patent Operation; John A. Kramer

(57) ABSTRACT

Various injector cooling structures and related engine systems and methods are provided. In one example, an injector cooling structure includes a cooling channel defined by a cooling jacket of a turbine. A cooling bore is provided at least partially within the cooling jacket, with the cooling bore configured to receive a pintle of an injector. The cooling channel is configured to circulate coolant for cooling the injector.

20 Claims, 3 Drawing Sheets

METHODS AND SYSTEMS FOR AN ENGINE

FIELD

Embodiments of the subject matter disclosed herein relate to injector cooling structures for an engine and related engine systems and methods.

BACKGROUND

During operation, internal combustion engines generate various combustion by-products that are emitted from the engine in an exhaust stream. Various approaches may be utilized in order to reduce regulated emissions. In some examples, particulate emissions may be reduced by employing an aftertreatment system with a device such as a particulate filter in an exhaust passage of the engine. Turbochargers may also be used in an engine system to increase a pressure of air supplied to the engine for combustion. In one example, the turbocharger includes a turbine coupled to an exhaust passage of the engine, with the turbine at least partially driving a compressor via a shaft to increase the intake air pressure.

Over time, a particulate load of the particulate filter may increase such that regeneration of the particulate filter is required. Regeneration serves to clean the particulate filter and thereby avoid an undesirable increase in backpressure on the engine, for example. One approach to cleaning the particulate filter involves raising the temperature of the exhaust upstream of the filter to promote the burning of carbonaceous particles that have accumulated in the filter. In one example, raising the exhaust temperature may be achieved through active regeneration of the filter by injecting hydrocarbons, such as fuel, upstream of the particulate filter. To achieve appropriate mixing of the injected hydrocarbons with the exhaust stream, a separate hydrocarbon mixer is often provided between the injection location and the particulate filter.

The inventors herein have recognized that when an injector is located in a high temperature environment such as an exhaust system, excessive heating of the injector can cause coking at the injector tip, injector degradation, and/or other component malfunction. Additionally, providing a separate hydrocarbon mixer in the exhaust system increases the required packaging space and design complexity of the system, while also increasing the overall backpressure experienced by the engine.

BRIEF DESCRIPTION

Thus, in one embodiment, an injector cooling structure includes a cooling channel that is defined by a cooling jacket of a turbine. (For example, the turbine may be part of a turbocharger in an engine system that includes an engine, the turbocharger, and an exhaust system.) A cooling bore is located at least partially within the cooling jacket, with the cooling bore configured to receive a pintle of an injector. The cooling channel is configured to circulate coolant for cooling the injector. Advantageously, by locating the injector pintle within the cooling bore, heat transfer from the turbine exhaust flow to the pintle and injector is reduced, thereby increasing injector efficiency and reliability.

In one embodiment a spray end of the cooling bore may open into an exhaust chamber of the turbine to enable the pintle to inject an additive into the exhaust chamber. In this manner, the exhaust chamber of the turbine may serve as a mixer to distribute the additive in the exhaust stream. Accordingly, by mixing the additive in the exhaust chamber of the turbine, an overall length of exhaust piping may be reduced.

Further, a separate mixer downstream in the exhaust piping may be avoided. Advantageously, eliminating a separate mixer may also reduce the overall backpressure created by the exhaust system.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of an injector cooling structure for an engine system that includes a turbocharger and an aftertreatment system. In one embodiment, the injector cooling structure includes a cooling channel that is defined by a cooling jacket of a turbine. A cooling bore located at least partially within the cooling jacket is configured to receive a pintle of an injector. The cooling channel is configured to circulate coolant for cooling the injector (e.g., the cooling channel is configured for coolant to be circulated therein). Advantageously, by locating the injector pintle within the cooling bore, heat transfer from turbine exhaust flow to the pintle and injector is reduced, thereby increasing injector efficiency and reliability.

In another exemplary embodiment, an engine system includes a turbocharger having a turbine with a cooling jacket, the turbine configured to be driven via exhaust gas from an engine. The cooling jacket includes a cooling channel configured to circulate coolant. A cooling bore within the cooling jacket is fully spaced away from the cooling channel and configured to receive a pintle of an injector. The injector is configured to inject an additive into an exhaust chamber of the turbine. In such an embodiment, the injector may be operated to inject hydrocarbons directly into the exhaust chamber of the turbine. In this manner, the injector enables improved mixing of the hydrocarbons with the exhaust gases upstream of the aftertreatment system for actively regenerating a particulate filter of the system. Such a configuration may also eliminate the need for a separate mixing component in the exhaust system of the engine. Further, by coupling the injector mounting structure to the turbine cooling jacket, excessive heating of the injector may be avoided.

In one embodiment, the turbocharger may be coupled to an engine in a vehicle. A locomotive system is used to exemplify one of the types of vehicles having engines to which the turbocharger may be attached. Other types of vehicles may include on-highway vehicles and off-highway vehicles other than locomotives or other rail vehicles, such as mining equipment and marine vessels. Other embodiments of the invention may also be used for turbochargers that are coupled to stationary engines. The engine may be a diesel engine, or may combust another fuel or combination of fuels. Such alternative fuels may include gasoline, kerosene, biodiesel, natural gas, and ethanol. Suitable engines may use compression ignition and/or spark ignition.

Figure 1:
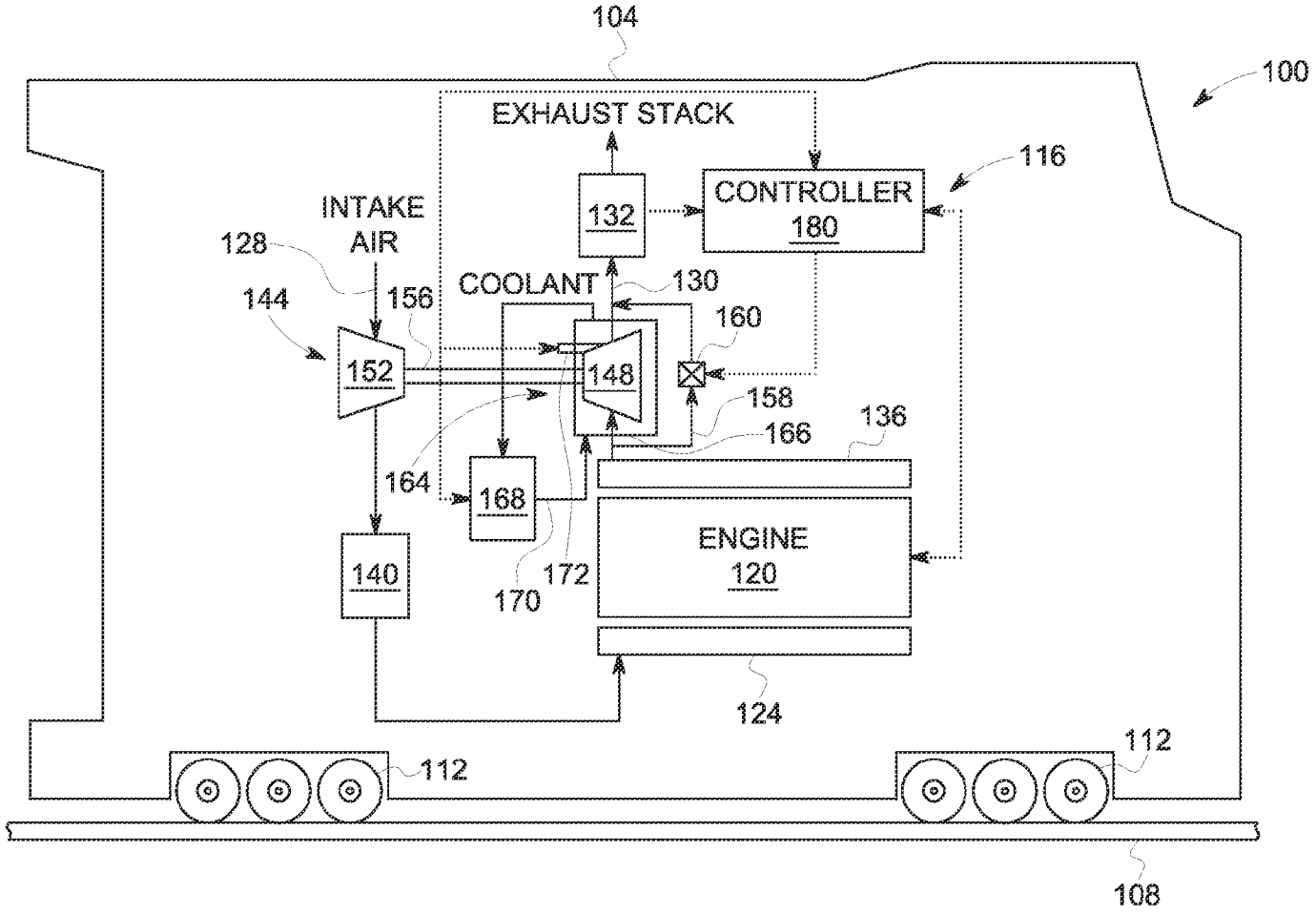
FIG. 1 shows a schematic diagram of an engine system including a turbocharger with an injector cooling structure, where the engine system is positioned in a rail vehicle, according to one embodiment of the present disclosure.

FIG. 1 shows a block diagram of an exemplary embodiment of a vehicle system 100, herein depicted as a locomotive or other rail vehicle 104 configured to run on a rail 108 via a plurality of wheels 112. As depicted, the rail vehicle 104 includes an engine system 116 with an engine 120, such as an internal combustion engine. In some embodiments, the engine 120 may be a two-stroke engine which completes a combustion cycle over one revolution (e.g., 360 degree rotation) of a crankshaft. In other embodiments, the engine 120 may be a four-stroke engine which completes the combustion cycle over two revolutions (e.g., 720 degree rotation) of the crankshaft. Further, in some examples, the engine 120 may be a V-12 engine having twelve cylinders. In other examples, the engine may be a V-6, V-8, V-10, V-16, I-4, I-6, I-8, opposed 4, or another engine type.

The engine 120 receives intake air for combustion from an intake, such as an intake manifold 124. The intake may be any suitable conduit or conduits through which gases flow to enter the engine. For example, the intake may include the intake manifold 124, an intake passage 128, and the like. The intake passage 128 receives ambient air from an air filter (not shown) that filters air from outside of the rail vehicle 104. Exhaust gas resulting from combustion in the engine 120 is supplied to an exhaust, such as exhaust passage 130. The exhaust may be any suitable conduit through which gases flow from the engine. For example, the exhaust may include an exhaust manifold 136, the exhaust passage 130, and the like. Exhaust gas flows through the exhaust passage 130 to an aftertreatment system 132 including a particulate filter, and out of an exhaust stack of the rail vehicle 104.

In the embodiment shown in FIG. 1, intake air flows through a heat exchanger such as intercooler 140 to reduce a temperature of (e.g., cool) the intake air before it enters the engine 120 for combustion. The intercooler 140 may be an air-to-air or air-to liquid heat exchanger, for example.

As depicted in FIG. 1, the vehicle system 100 further includes a turbocharger 144 arranged between the intake passage 128 and the exhaust passage 130. The turbocharger 144 increases air charge of ambient air drawn into the intake passage 128 in order to provide greater charge density during combustion to increase power output and/or engine-operating efficiency. As depicted, the turbocharger 144 includes a turbine 148 which drives a compressor 152 via a shaft 156 that mechanically couples the turbine 148 and the compressor 152.

The vehicle system 100 further includes a bypass 158 with a bypass control element 160, such as a wastegate, that may be controlled to adjust the flow of exhaust gas around the turbine 148. By adjusting the flow of exhaust gas around (or through) the turbine 148, the amount of energy extracted from exhaust flow through the turbine may be varied. For example, the bypass control element 160 is operably coupled with the bypass 158 such that a position of the bypass control element 160 governs an extent to which the bypass 158 is open for passage of fluid such as exhaust gas. The bypass control element 160 may be opened, for example, to divert the exhaust gas flow away from the turbine 148. In this manner, the rotating speed of the compressor 152, and thus the boost provided by the turbocharger 144 to the engine 120, may be regulated. Consequently, the amount of energy extracted by the turbocharger 144 from exhaust flow through the turbine 148 may be adjusted. The bypass control element 160 may be any element that can be controlled to selectively partially or completely block a passage. As an example, the bypass valve may be a gate valve, a butterfly valve, a globe valve, an adjustable flap, or the like.

In other embodiments, the cylinders may of the engine 120 be divided into two sets, where exhaust gas from one set of cylinders always flows through the turbine 148 and exhaust gas from the second set selectively flows through the turbine based on a position of a bypass control element.

The engine system 116 further includes an injector cooling structure 164 that includes a cooling jacket 166 coupled to an exterior surface of the turbine 148. In one embodiment the cooling jacket 166 may substantially encircle an exterior surface of the turbine 148. In other examples the cooling jacket 166 may extend along a portion or portions of the exterior surface of the turbine 148.

Figure 2:
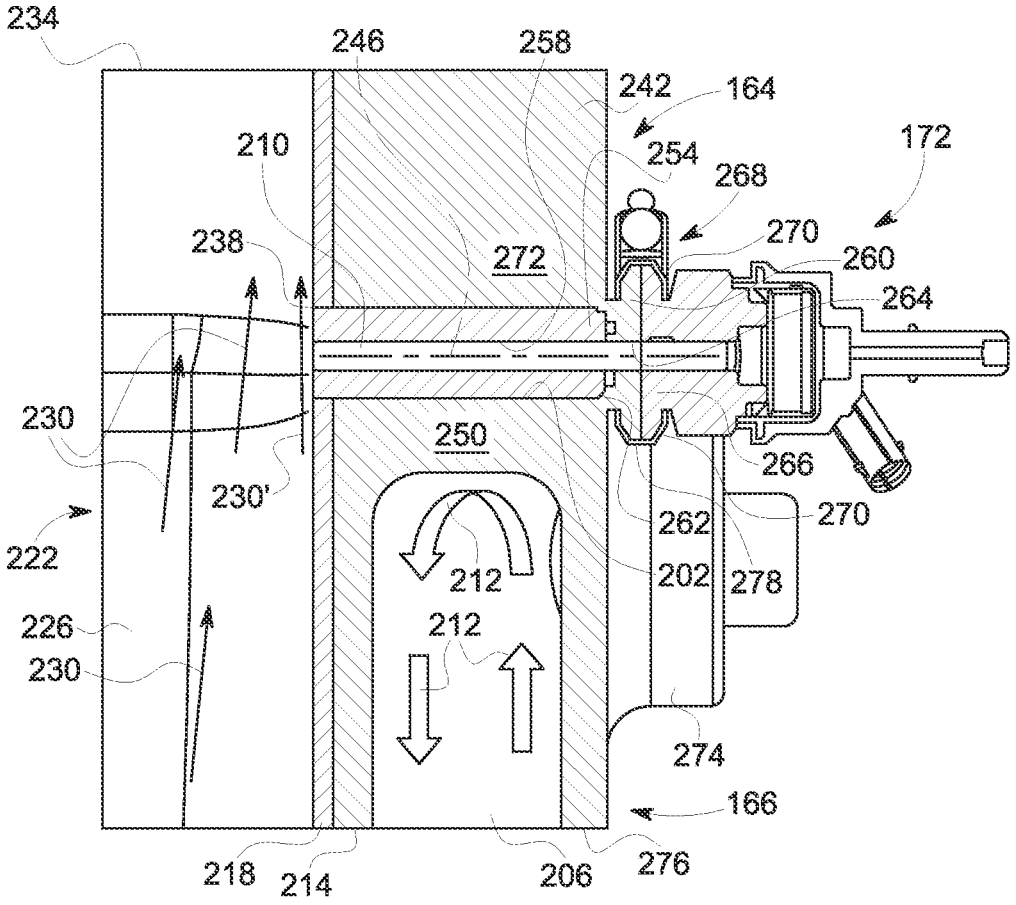
FIG. 2 shows a cut away view, approximately to scale, of an embodiment of an injector cooling structure and an exhaust chamber of a turbine.
Figure 3:
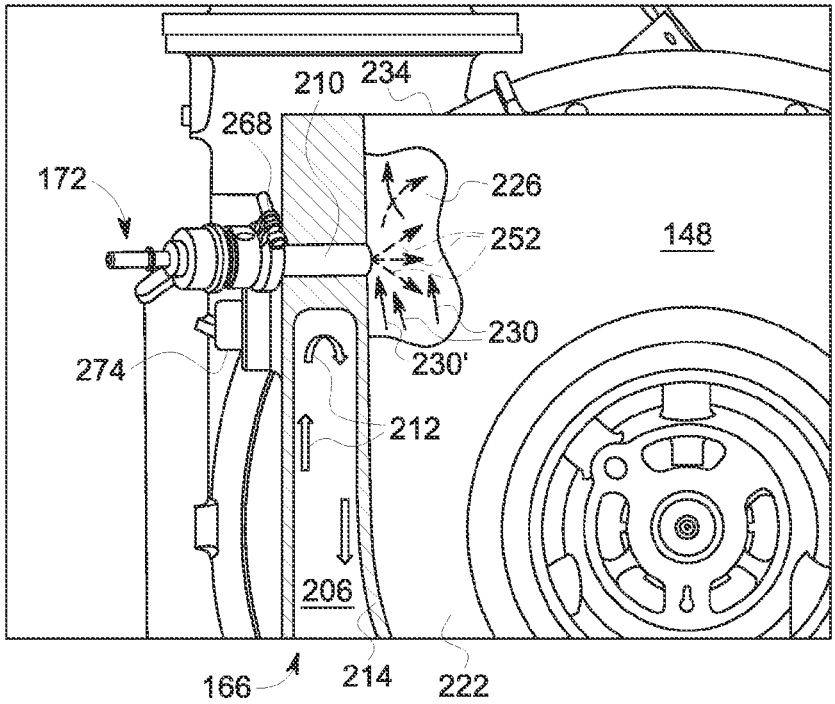
FIG. 3 shows another cut away view, approximately to scale, of the injector cooling structure and the exhaust chamber of the turbine of FIG. 2.

With reference also to FIGS. 2 and 3, a cooling bore 202 within the cooling jacket 166 is configured to receive the pintle 210 of an injector 172 for injecting into the turbine 148 an additive that facilitates regeneration of the particulate filter in the downstream aftertreatment system 132. The pintle 210 includes an injection aperture (not shown) through which the additive may be injected. The additive may comprise, for example, diesel fuel, diesel exhaust fluid such as urea, and/or other suitable catalysts for increasing the temperature of the exhaust stream to facilitate active regeneration of particulate matter trapped in the aftertreatment system 132.

In other examples, two or more cooling bores and associated injectors may be provided in the cooling jacket 166 to inject additives into the turbine 148. It still other examples, the engine system 116 may include a second turbocharger to form a two-stage turbocharger system including a high pressure turbocharger and a low pressure turbocharger. In such examples, one or more cooling bores and associated injectors may be provided in the cooling jacket of the turbine in either the high pressure turbocharger or the low pressure turbocharger. In other examples, one or more cooling bores and associated injectors may be provided in the cooling jackets of the turbines of both the high pressure and the low pressure turbochargers.

The cooling jacket 166 is in fluid communication with a coolant system 168 of engine system 116 and receives coolant from the coolant system via cooling conduit 170. As described in more detail below, the cooling jacket 166 is in thermal contact with at least a portion of the surface of the turbine 148. In this manner, the coolant circulating within the cooling jacket 166 facilitates heat transfer from the turbine and the heated exhaust within the turbine to the coolant. After passing through the cooling jacket 166, the coolant is routed through cooling system 168 which rejects heat from the coolant (cools the coolant) and returns the cooled coolant to the cooling jacket 166. The coolant system 168 may also provide coolant to engine 120 and other components of engine system 116. In some examples, the coolant system 168 may take the form of a heat exchanger, radiator, intercooler, or any other suitable component providing heat transfer from one thermal transport fluid to another.

As used herein, coolant refers to a thermal transport fluid such as a liquid, semi-liquid material, or gas. Examples of suitable coolants include water, glycols, salt solutions, alcohols, intake air, and mixtures of two or more of the foregoing. In some implementations, more exotic materials and/or performance affecting additives are contemplated, and may include corrosion resistors, defoamers, anti-sludge agents, detergents, anti-gelling agents, biocidal agents, leak preventers (such as silicates) or locators (such as dye), anti-freezing agents (such as the above mentioned glycols and alcohols), and the like.

The rail vehicle 104 includes a controller 180 that may be configured to control various components related to the vehicle system 100. For example, the controller 180 may be configured to adjust the injector 172 (e.g., by generating control signal(s) to which the injector is responsive) to control the injection of additive into the turbine 148. In this manner, an exhaust gas temperature downstream of the turbine 148 and upstream of the aftertreatment system 132 may be increased such that the particulate filter in the aftertreatment system 132 may be regenerated. It will be appreciated that the controller 180 may also control operation of the engine 120, coolant system 168, aftertreatment system 132, bypass control element 160, and other components of the engine system 116.

In one example, the controller 180 includes a computer control system. The controller 180 further includes non-transitory, computer readable storage media (not shown) including code for enabling on-board monitoring and control of rail vehicle operation. The controller 180, while overseeing control and management of the vehicle system 100, may be configured to receive signals from a variety of engine sensors, as further elaborated herein, in order to determine operating parameters and operating conditions, and correspondingly adjust various engine actuators to control operation of the rail vehicle 104. For example, the controller 180 may receive signals from various engine sensors including, but not limited to, engine speed, engine load, engine temperature, boost pressure, ambient pressure, coolant temperature, coolant pressure, exhaust temperature, exhaust pressure, etc. Correspondingly, the controller 180 may control the vehicle system 100 by sending commands to various components such as traction motors, alternator, cylinder valves, throttle, heat exchangers, pumps, wastegates or other valves or flow control elements, etc.

Turning now to FIGS. 2 and 3, an embodiment of an injector cooling structure 164 and associated cooling jacket 166 that are coupled to a turbine 148 of a turbocharger and receive an injector 172 will now be described. The following description discusses the injector cooling structure 164 with the engine system 116 and related components as shown in FIG. 1 and described above. It will be appreciated that the injector cooling structure 164 may also be used with other engine systems and related components having different configurations and/or structures.

The injector cooling structure 164 includes a cooling channel 206 that is defined by the cooling jacket 166 and is fluidically coupled to the coolant system 168 of the engine system 116. In this manner, coolant may be circulated within the cooling channel 206 as indicated by action arrows 212. In one embodiment the cooling channel 206 and cooling jacket 166 may substantially encircle an exhaust section 222 of the turbine 148. In other examples the cooling channel 206 and cooling jacket 166 may extend along a portion or portions of an exhaust section 222 of the turbine 148. In still other examples, the cooling jacket 166 may substantially encircle the exhaust section 222, while the cooling jacket extends along a portion or portions of the exhaust section 222.

The cooling channel 206 may include an inner wall 214 that is in contact with at least a portion of an exterior wall 218 of an exhaust section 222 of the turbine 148. The exterior wall 218 of the exhaust section 222 defines at least a portion of an exhaust chamber 226 of the exhaust section. The geometry of the exhaust section 222 may direct the exhaust flow, indicated by action arrows 230, 230', to an exhaust outlet 234 of the turbine 148. As explained in more detail below, a spray end 238 of the cooling bore 202 may be positioned at a location in the exhaust chamber 226 of the turbine 148 where the exhaust flow 230, 230' within the exhaust chamber is traveling substantially toward the exhaust outlet 234 of the turbine. In an advantage that may be realized in the practice of some embodiments disclosed herein, this configuration may provide improved mixing of an additive injected by the injector 172 into the exhaust chamber 226.

The cooling bore 202 of the injector cooling structure 164 may be located at least partially within the cooling jacket 166. As illustrated in FIGS. 2 and 3, in one example the cooling jacket 166 includes an extension 242 having an upper portion 272 and a lower portion 250 that extend above the cooling channel 206. In this example, the cooling bore 202 extends through the extension 242 of the cooling jacket 166.

As noted above, the geometry of the exhaust section 222 may direct the exhaust flow 230/230' to an exhaust outlet 234 of the turbine 148. In one example, and to advantageously provide improved mixing of an injected additive with the exhaust flow 230, 230', the spray end 238 of the cooling bore 202 may open into the exhaust chamber 226 at a location where the exhaust flow exhibits high flow velocity and uniformity. In this manner, the injected additive indicated by action arrows 252 and exhaust flow 230, 230' may achieve improved mixing within the exhaust chamber 226 and in the exhaust passage 130 downstream from the exhaust outlet 234.

To achieve such improved mixing, in one example, the spray end 238 of the cooling bore 202 may be located adjacent to the exhaust outlet 234 of the turbine 148. In this example, the spray end of the cooling bore is positioned at a location in the exhaust chamber of the turbine where exhaust flow within the exhaust chamber is traveling substantially toward the exhaust outlet of the turbine.

The cooling bore 202 may also be positioned such that a longitudinal axis 246 of the cooling bore is substantially perpendicular to a direction of a portion of the exhaust flow 230' within the exhaust chamber 226 at a location adjacent to the spray end 238 of the cooling bore. As shown in FIG. 2, in one example the geometry of the exhaust chamber 226 may be configured such that at least a portion of the exhaust flow, indicated by action arrow 230', travels substantially along the exterior wall 218 of the exhaust chamber and upwardly toward the exhaust outlet 234. In this manner, and with the longitudinal axis 246 of the cooling bore 202 positioned substantially perpendicular to the direction of exhaust flow 230', additive ejected from the pintle 210 along its longitudinal axis may initially engage with the exhaust flow 230' at a perpendicular angle to provide improved initial mixing of the additive with the exhaust flow.

As shown in FIGS. 2 and 3, the cooling bore 202 is in thermal communication with the cooling channel 206 via lower portion 250 of extension 242 to facilitate heat transfer from the pintle 210 and other components of the injector cooling structure 16 to the coolant in the cooling channel. In the example illustrated in FIGS. 2 and 3, the lower portion 250 of the extension 242 separates the cooling bore 202 from the cooling channel 206. In this manner, the cooling bore 202 is fully spaced away from the cooling channel 206 such that no portion of the cooling bore extends through the cooling channel.

In one example, the injector cooling structure 164 further includes a sleeve 254 that is located within and extends through the cooling bore 202, with the sleeve configured to receive the pintle 210 of the injector 172. As shown in FIG. 2, the sleeve 254 includes a receiving bore 258 that receives and locates the pintle 210. The sleeve 254 may be composed of thermally conductive material, such as aluminum or copper, to facilitate heat transfer from the pintle 210 to the cooling channel 206. In some examples, various sleeves having receiving bores of different diameters may be used to accommodate injectors having pintles of different diameters. In other examples, the injector cooling structure 164 may not utilize a sleeve inside the cooling bore 202. In these examples, the inner diameter of the cooling bore 202 is sized to directly receive the pintle 210 of the injector 172.

In embodiments, a mounting boss 260 extends laterally from an entry end 262 of the cooling bore 202. The mounting boss 260 includes a central bore 264 that is coaxial with the longitudinal axis 246 of the cooling bore 202, and through which the pintle 210 may extend into the cooling bore. The mounting boss 260 is configured to be coupled to a mounting flange 266 of the injector 172. In one example, a mounting clamp 268 may be configured to releasably couple the mounting boss 260 to the mounting flange 266 of the injector 172. The mounting clamp may include a band 270 configured to encircle a periphery of the mounting boss 260 and a periphery of the mounting flange 266 of the injector 172. Advantageously, the mounting clamp 268 enables the injector 172 to be easily installed and removed for repair or replacement.

Further, in the configuration illustrated in FIGS. 2 and 3, the lower portion 250 of the extension 242 and the upper portion 272 of the extension laterally separate the mounting clamp 268 and mounting boss 260 from the exhaust chamber 226 of the turbine 148. Advantageously, with this configuration the mounting clamp 268 and mounting boss 260 are thermally separated from the exhaust chamber 226 by at least a portion of the extension 242. Additionally, the lower portion 250 and upper portion 272 of the extension 242 may conduct heat away from the mounting clamp 268 and mounting boss 260 to the cooling channel 206. In this manner, this configuration of the injector cooling structure 164 may reduce heat transfer from the exhaust chamber 226 to the mounting clamp 268 and mounting boss 260, thereby reducing thermal fatigue on these components that can lead to malfunction and shorter component life.

The injector cooling structure 164 may alternatively or additionally include a support projection 274 that extends from an outer wall 276 of the cooling jacket 166. The support projection 274 includes a groove 278 that is configured to seat at least the mounting flange 266 of the injector 172. As shown in FIGS. 2 and 3, in one example the groove 278 is configured to receive and seat the mounting flange 266 and mounting boss 260 coupled by the band 270 of the mounting clamp 268. In one embodiment, at least a portion of the support projection 274 is located laterally adjacent to the cooling channel 206. For example, the support projection 274 may be laterally proximate to the cooling channel 206, meaning next to (in a direction perpendicular to a longitudinal or center axis of the cooling channel) and sufficiently close to the cooling channel for at least 100 watts of heat transfer (i.e., 100 J/s) between the injector 172 and cooling channel when an injector temperature is 50 degrees C. and the cooling channel is 5 degrees C., for example. Advantageously, with this configuration the support projection 274 may also conduct heat away from the mounting flange 266, mounting boss 260, and pintle 210 of the injector 172 to the cooling channel 206 to further reduce thermal fatigue at the mounting clamp 268, mounting boss 260, and the injector 172 and its associated components.

Figure 4:
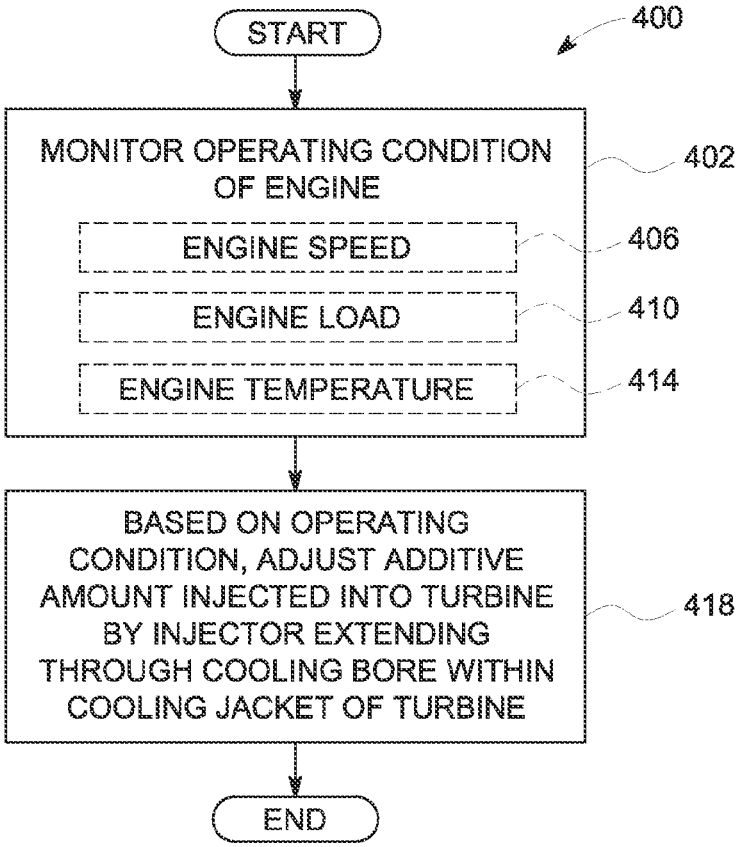
FIG. 4 shows a flow chart illustrating a method for an injector according to one embodiment of the present disclosure.

With reference now to FIG. 4, a flow chart illustrating an embodiment of a method 400 for an injector, such as the injector 172 described above with reference to FIGS. 1-3 and engine system 116, is shown. Advantageously, the method 400 enables monitoring one or more operating conditions of an engine and adjusting an amount of an additive injected into a turbine of the engine, with the turbine including a cooling jacket and a cooling bore within the cooling jacket. The following description of method 400 and other examples of methods described below is provided with reference to the components and configuration of the exemplary engine system 116 and injector cooling structure 164 described above and shown in FIGS. 1-3. It will be appreciated that method 400 and the other example methods described below may also be performed in other contexts and environments using other suitable engines, components and configurations.

In one embodiment, at 402 the method 400 includes monitoring at least one operating condition of the engine system 116. As noted above, controller 180 may receive signals from various engine sensors. Accordingly, the controller 180 may monitor one or more of various engine operating conditions, such as engine speed 406, engine load 410, or engine temperature 414. Other engine conditions that may be monitored include boost pressure, ambient pressure, exhaust temperature, exhaust pressure, coolant temperature, coolant pressure, etc.

At 418, and based on at least one operating condition that is monitored, the method 400 may include adjusting an amount of an additive injected into the turbine 148 of the engine system 116 by the injector 172, with the turbine including cooling jacket 166 and the injector extending through the cooling bore 202 within the cooling jacket. For example, by monitoring one or more operating conditions of the engine system 116, a particulate load of the particulate filter in the aftertreatment system 132 may be estimated. As one example, the particulate load may be determined based on a pressure drop across the particulate filter. As another example, the particulate load may be determined from a soot model based on an amount of soot trapped and an amount of soot oxidized over time. As yet another example, the particulate load may be determined based on one or more soot sensors positioned upstream and/or downstream of the particulate filter.

If the estimated particulate load is above a threshold particulate load, then the amount of additive injected into the turbine 148 may be increased. A threshold particulate load may be a particulate load at which a backpressure in the exhaust passage 130 upstream of the particulate filter begins increasing and/or when an efficiency of the engine 120 begins decreasing. Accordingly, by increasing the amount of additive that is injected, the temperature of the exhaust gas may be correspondingly increased to facilitate regeneration of the particulate filter in the aftertreatment system 132.

Another embodiment relates to an engine system. The engine system comprises a turbocharger having a turbine, with a cooling jacket coupled to the turbine. The cooling jacket includes a cooling channel configured to circulate coolant. A cooling bore within the cooling jacket is fully spaced away from the cooling channel. The cooling bore is configured to receive a pintle of an injector, with the injector configured to inject an additive into an exhaust chamber of the turbine.

Another embodiment relates to an article of manufacture. The article includes a turbine having an exhaust outlet for discharging an exhaust flow to an exhaust passage and a downstream aftertreatment system including a particulate filter. The article further includes a cooling jacket coupled to the turbine and including a cooling channel that is configured to circulate coolant received from a coolant system. The article further includes a cooling bore within the cooling jacket, with the cooling bore configured to receive a pintle of an injector. The injector is configured to inject an additive into an exhaust chamber of the turbine to facilitate regeneration of the particulate filter in the aftertreatment system.

In an embodiment, such as in any of the other embodiments described herein, the aftertreatment system may comprise a selective catalytic reduction (SCR) system that includes one or more SCR catalysts. The SCR catalysts may include, for example, one or more ceramic materials used as a carrier, and one or more active catalytic components such as, for example, molybdenum, vanadium, tungsten, or any other suitable catalytic component. In such an embodiment, the injector may be operated to inject additives directly into the exhaust chamber of the turbine. Such additives may include, for example, urea, aqueous ammonia, anhydrous ammonia, or any other suitable reductant.

Another embodiment relates to an engine system comprising an engine and a turbocharger operably coupled to the engine. The turbocharger comprises a turbine and a cooling jacket at least partially around the turbine. The cooling jacket defines a cooling channel for receiving a coolant, and there is a bore at least partially within the cooling jacket. A mounting boss is attached to the cooling jacket at an entry end of the bore, and extends out from the cooling jacket. The engine system further comprises an injector having a pintle and a mounting flange. The pintle is received in the bore. The mounting flange abuts the mounting boss, and the engine system further comprises a mounting clamp releasably coupling the mounting boss to the mounting flange of the injector. In operation, coolant is circulated through the coolant channel for cooling the injector. The injector is controlled to inject an additive into an exhaust chamber of the turbine.

Another embodiment relates to an engine system comprising an engine and a turbocharger operably coupled to the engine. The turbocharger comprises a turbine having a turbine wall that at least partially defines an exhaust chamber. (For example, a rotatable impeller may be housed with the exhaust chamber for being acted upon by exhaust passing through the exhaust chamber.) The turbine further comprises a cooling jacket abutting the turbine wall or otherwise in thermal connection with the turbine wall. The cooling jacket defines a cooling channel for receiving a coolant. A bore, spaced apart from the cooling channel but in thermal connection therewith (that is, heat may transfer from the bore to the cooling channel), extends through the cooling jacket from an entry end to a spray end; the spray end opens up into the exhaust chamber. A mounting boss is attached to the cooling jacket at the entry end of the bore, and extends out from the cooling jacket. The engine system further comprises an injector having a pintle and a mounting flange. The pintle is received in the bore, and includes an injection aperture that is fluidly coupled with the exhaust chamber, such that an additive injected by the injector through the pintle and out the injection aperture enters the exhaust chamber. The mounting flange abuts the mounting boss, and the engine system further comprises a mounting clamp releasably coupling the mounting boss to the mounting flange of the injector. The engine system further comprises a cooling system fluidly coupled with the coolant channel. In operation, liquid coolant is circulated by the cooling system through the coolant channel for cooling at least the injector pintle. The injector is controlled to inject an additive into an exhaust chamber of the turbine.

As used in the description above, the terms "high pressure" and "low pressure" are relative, meaning that "high" pressure is a pressure higher than a "low" pressure. Conversely, a "low" pressure is a pressure lower than a "high" pressure. Additionally, an element or step recited in the singular and proceeded with the word "a" or "an" should be understood as not excluding plural of said elements or steps, unless such exclusion is explicitly stated. References to "one embodiment" or "an embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein."

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for an injector, comprising:

monitoring at least one operating condition of an engine system; and based on the at least one operating condition, adjusting an amount of an additive injected into a turbine of the engine system by the injector, the turbine including a cooling jacket having an extension, the injector extending through a cooling bore within the extension of the cooling jacket such that the cooling bore is separated from a cooling channel defined by the coolant jacket.

2. The method of claim 1, wherein the at least one operating condition comprises an engine speed, an engine load, or an engine temperature.

3. An injector cooling structure, comprising:

a cooling channel defined by a cooling jacket of a turbine; and a cooling bore at least partially within the cooling jacket, the cooling bore configured to receive a pintle of an injector, wherein the cooling channel is configured to circulate coolant for cooling the injector, the cooling jacket including an extension, the cooling bore extending through the extension such that the cooling bore is separated from the cooling channel.

4. The injector cooling structure of claim 3, further comprising a mounting boss extending from an entry end of the cooling bore, the mounting boss configured to be coupled to a mounting flange of the injector.

5. The injector cooling structure of claim 4, further comprising a mounting clamp configured to releasably couple the mounting boss to the mounting flange of the injector, and wherein the extension of the cooling jacket laterally separates the mounting clamp and the mounting boss from an exhaust chamber of the turbine.

6. The injector cooling structure of claim 5, wherein the mounting clamp comprises a band configured to encircle a periphery of the mounting boss and a periphery of the mounting flange.

7. The injector cooling structure of claim 4, further comprising a support projection extending from the cooling jacket, the support projection including a groove configured to seat at least the mounting flange of the injector.

8. The injector cooling structure of claim 7, wherein at least a portion of the support projection is laterally adjacent to the cooling channel.

9. The injector cooling structure of claim 3, further comprising a sleeve extending through the cooling bore, the sleeve configured to receive the pintle of the injector.

10. The injector cooling structure of claim 3, wherein the cooling bore includes a spray end that opens into an exhaust chamber of the turbine, the spray end configured to enable the pintle to inject an additive into the exhaust chamber of the turbine.

11. The injector cooling structure of claim 10, wherein a longitudinal axis of the cooling bore is substantially perpendicular to a direction of exhaust flow within the exhaust chamber of the turbine at a location adjacent to the spray end of the cooling bore.

12. The injector cooling structure of claim 10, wherein the spray end of the cooling bore is positioned at a location in the exhaust chamber of the turbine where exhaust flow within the exhaust chamber is traveling substantially toward an exhaust outlet of the turbine.

13. The injector cooling structure of claim 3, wherein the cooling channel is fluidically coupled to a coolant system of an engine system to receive the coolant from the coolant system.

14. An engine system comprising:

an injector;

a turbocharger;

a cooling jacket coupled to a turbine of the turbocharger and including a cooling channel configured to circulate coolant; and a cooling bore within the cooling jacket and fully spaced away from the cooling channel, the cooling bore configured to receive a pintle of the injector, the injector configured to inject an additive into an exhaust chamber of the turbine.

15. The engine system of claim 14, wherein the cooling bore includes a spray end that extends through an inner wall of the cooling jacket, the spray end configured to enable the pintle of the injector to inject the additive into the exhaust chamber.

16. The engine system of claim 15, wherein a longitudinal axis of the cooling bore is substantially perpendicular to a direction of exhaust flow within the exhaust chamber of the turbine at a location adjacent to the spray end of the cooling bore.

17. The engine system of claim 15, wherein the spray end of the cooling bore is positioned at a location in the exhaust chamber of the turbine where exhaust flow within the exhaust chamber is traveling substantially toward an exhaust outlet of the turbine.

18. The engine system of claim 14, further comprising:

a mounting boss engaging an entry end of the cooling bore; and a mounting clamp configured to releasably couple the mounting boss to a mounting flange of the injector, and wherein an extension of the cooling jacket laterally separates the mounting clamp from the exhaust chamber of the turbine.

19. The engine system of claim 14, further comprising a coolant system that is fluidically coupled to the cooling channel and configured to supply the coolant to the cooling channel for cooling the turbine and the injector, wherein the coolant comprises a liquid coolant.

20. The engine system of claim 14, further comprising an aftertreatment system disposed downstream from the turbine and comprising a particulate filter.

* * * * *